US009487044B2

(12) United States Patent
Hagspiel

(10) Patent No.: US 9,487,044 B2
(45) Date of Patent: Nov. 8, 2016

(54) METHOD AND DEVICE FOR PRODUCING A BOARD-SHAPED PRODUCT HAVING A SURFACE COMPRISING A DECORATION

(75) Inventor: Raimund Hagspiel, Hoxter (DE)

(73) Assignee: Fritz Egger GmbH & Co. OG, Unterradlberg (AT)

( * ) Notice: Subject to any disclaimer, the term of this patent is extended or adjusted under 35 U.S.C. 154(b) by 125 days.

(21) Appl. No.: 13/583,406

(22) PCT Filed: Jan. 19, 2011

(86) PCT No.: PCT/EP2011/050671

§ 371 (c)(1),
(2), (4) Date: Nov. 9, 2012

(87) PCT Pub. No.: WO2011/110373

PCT Pub. Date: Sep. 15, 2011

(65) Prior Publication Data

US 2013/0088556 A1 Apr. 11, 2013

(30) Foreign Application Priority Data

Mar. 9, 2010 (DE) ..... 10 2010 010 784

(51) Int. Cl.

| | |
|---|---|
| ***B44C 1/24*** | (2006.01) |
| ***B44C 5/04*** | (2006.01) |
| ***B44F 9/02*** | (2006.01) |
| ***B44F 9/04*** | (2006.01) |
| ***B44F 11/04*** | (2006.01) |

(Continued)

(52) U.S. Cl.

CPC ..... *B44C 1/24* (2013.01); *B44C 5/043* (2013.01); *B44C 5/0461* (2013.01); *B44F 9/02* (2013.01); *B44F 9/04* (2013.01); *B44F 11/04* (2013.01); *E04F 13/0866* (2013.01); *E04F 15/107* (2013.01)

(58) Field of Classification Search

CPC .. B41M 1/10; B41M 7/0027; B41M 7/0036; B41M 7/0045; B41M 7/0054; B41M 7/0072; B41M 7/0081; B41M 7/009; B41M 5/0076; B41M 5/0082; B41M 5/0088; B41M 1/38; B41M 1/40

USPC ..... 347/103

See application file for complete search history.

(56) References Cited

U.S. PATENT DOCUMENTS 5,609,222 A 3/1997 Horbacewicz et al.
5,810,487 A * 9/1998 Kano et al. ..... 400/83

(Continued)

FOREIGN PATENT DOCUMENTS

DE EP 1923223 A1 * 5/2008 ..... B41J 2/0057
EP 1580015 A1 * 9/2005 ..... B41M 3/14

(Continued)

*Primary Examiner* — Matthew Luu
*Assistant Examiner* — Patrick King
(74) *Attorney, Agent, or Firm* — The Webb Law Firm

(57) ABSTRACT

A method and device for producing a board-shaped product having a surface comprising a decoration, having at least one printing roller unit for printing a decoration onto a main body formed from a carrier board, wherein at least one digital print head for printing at least one decoration element onto one or more sub-regions of the main body such that the decoration printed by means of the at least one printing roller unit remains visible, at least in part, or surrounds the decoration element if the at least one decoration element is printed onto the main body by means of the at least one digital print head before the decoration.

18 Claims, 3 Drawing Sheets

(51) Int. Cl.
*E04F 13/08* (2006.01)
*E04F 15/10* (2006.01)

(56) References Cited

U.S. PATENT DOCUMENTS

| | | | | |
|---|---|---|---|---|
| 7,240,985 | B2 * | 7/2007 | Rogers, IV | B41J 2/51 347/104 |
| 2005/0249924 | A1 | 11/2005 | Reichwein et al. | |
| 2006/0075916 | A1 * | 4/2006 | Edwards | B41J 11/0015 101/483 |
| 2007/0196624 | A1 | 8/2007 | Chen et al. | |
| 2007/0266877 | A1 * | 11/2007 | Oldorff | B41J 3/407 101/483 |
| 2009/0064884 | A1 * | 3/2009 | Hook et al. | 101/450.1 |
| 2009/0318591 | A1 * | 12/2009 | Ageishi et al. | 524/88 |
| 2010/0087945 | A1 * | 4/2010 | Nakajima | G02F 1/1303 700/105 |
| 2010/0196678 | A1 * | 8/2010 | Vermeulen | 428/195.1 |
| 2011/0059239 | A1 | 3/2011 | Oldorff | |
| 2011/0132213 | A1 * | 6/2011 | DeJoseph et al. | 101/130 |
| 2012/0076517 | A1 * | 3/2012 | Rapkin et al. | 399/24 |
| 2012/0076518 | A1 * | 3/2012 | Rapkin et al. | 399/24 |
| 2013/0120512 | A1 * | 5/2013 | Hook et al. | 347/95 |

FOREIGN PATENT DOCUMENTS

| | | | | |
|---|---|---|---|---|
| EP | 1762400 | A1 | 3/2007 | |
| EP | 1923223 | A1 * | 5/2008 | |
| EP | 2098380 | A2 | 9/2009 | |
| EP | 2452829 | A1 | 5/2012 | |
| JP | 2003312117 | A | 11/2003 | |
| MT | EP 2636531 | A1 * | 9/2013 | B41M 5/03 |
| WO | 9829636 | A1 | 7/1998 | |
| WO | 2006002917 | A2 | 1/2006 | |

* cited by examiner

METHOD AND DEVICE FOR PRODUCING A BOARD-SHAPED PRODUCT HAVING A SURFACE COMPRISING A DECORATION

BACKGROUND OF THE INVENTION

1. Field of the Invention

The invention relates to a method for producing a board-shaped product having a surface comprising a decoration, in which method a decoration is printed by means of at least one printing roller unit onto a main body which is formed from a carrier board made of wood material, of laminate and/or of a compact board. The invention also relates to a device for producing a board-shaped product having a surface comprising a decoration, which device comprises at least one printing roller unit for printing a decoration onto a main body which is formed from a carrier board made of wood material, of laminate and/or of a compact board.

2. Description of Related Art

Methods and devices for printing a wood decoration directly onto wood material boards are known. In comparison with the prior art, in which decorative surfaces can be obtained on wood material boards by coating said boards with printed paper, these methods and devices offer the advantage that a counteracting layer on the back of the board is unnecessary. As a result, the production costs for corresponding wood material boards comprising a decoration can be reduced.

WO 2006/002917 A2 of the Applicant describes for example a method for producing a board having a surface comprising a decoration, the board consisting of a substrate based on lignocellulose material. In this known method, a previously ground surface which is to be provided with a decoration, in particular a wood decoration, is primed, then smoothed and then printed on directly by means of printing rollers (printing cylinders) using the gravure printing method in order to produce the decoration.

Besides roller printing, digital printing is also used to produce panels comprising decorative surfaces. Thus, for example, WO 98/26936 A1 discloses a method for producing resin-impregnated decorative papers for coating carrier boards. The carrier boards (laminates) coated in this manner are intended in particular for the furniture industry. In the known method, a digital image is printed on resin-impregnated paper by means of a digital printer, in particular a laser printer.

Owing to their high printing speed, roller printing methods are well suited to producing large numbers of decorative panels. With regard to the production of panels, in particular floor panels, roller printing usually involves repeating the printed decoration. The frequency with which the decoration is repeated may in principle be influenced only by the diameter and the length of the printing rollers. However, the two parameters cannot be varied as desired, but are limited for technical reasons. In contrast, digital printing methods have in principle unlimited scope for individualising the decoration. The scope for individualisation basically depends only on the available storage capacity for providing the digital decoration data, the currently available computing power and the creativity of the decoration developer. On the other hand, digital printing is comparatively expensive, since the productivity which can be achieved using a digital printing system is limited and relatively low.

The object of the present invention is to provide a method and a device of the type mentioned at the outset which offer unlimited potential for individualising the decoration at relatively high productivity and favourable production costs.

SUMMARY OF THE INVENTION

The method according to the invention, in which a decoration is printed by means of at least one printing roller unit onto a main body which is formed from a carrier board made of wood material, of laminate and/or of a compact board, is basically characterised in that at least one decoration element is printed by means of at least one digital print head onto one or more sub-regions of the main body such that the decoration printed by means of the at least one printing roller unit remains visible, at least in part, or surrounds the at least one decoration element if the at least one decoration element is printed onto the main body by means of the at least one digital print head before the decoration.

The device according to the invention, which comprises at least one printing roller unit for printing a decoration onto a main body which is formed from a carrier board made of wood material, of laminate and/or of a compact board, accordingly comprises at least one digital print head for printing at least one decoration element onto one or more sub-regions of the main body such that the decoration printed by means of the at least one printing roller unit remains visible, at least in part, or surrounds the at least one decoration element if the at least one decoration element is printed onto the main body by means of the at least one digital print head before the decoration.

The invention is thus based on the idea of combining gravure printing and digital printing in order to produce board-shaped main bodies, in particular wood material boards, for example as floor boards, having a surface comprising a decoration.

A digital printing system for printing all over the upper face of a carrier board has a relatively low printing speed. However, in the method according to the invention and the device according to the invention, the at least one digital print head is used only for printing on part of the upper face of a board-shaped main body or of a carrier board, and therefore the printing speed and thus the output is higher than in the case of a system which uses exclusively digital printing.

The inks required for a digital printing system cost many times more than the printing inks which can be used in generic gravure printing systems. Compared to a digital printing system for printing all over the upper face of a carrier board, the device according to the invention is thus characterised by substantially more favourable consumables costs.

Since at least one decoration element is printed on only one or more sub-regions of the board-shaped main body by means of the at least one digital printing head, in terms of the digital printing there is no need for full reproduction with regard to the surface of the main body which is to be provided with a decoration. As a result, simpler software architecture or software programming is possible compared to a method using exclusively digital printing.

A further advantage of the solution according to the invention arises with respect to an engraved printing roller which is already present, in that the decoration printed by means of the printing roller is varied by means of the at least one digital print head. Thus, for example, a strip flooring decoration printed by means of a printing roller which is already present can be provided with longitudinal and transverse lines by means of the at least one digital print head, in order thus to improve the appearance of joints in the strip flooring decoration.

The at least one decoration element which is printed by means of the at least one digital print head can be one or more decoration elements of the following types of decoration elements:

a) Decoration elements which reproduce the structure of the material to be imitated. In the case of wood, this may be the grain, heart and sap wood, knots, resin galls, worm grooves, stains from fungi, reaction wood, etc. In the case of stone, this may be different stains, inclusions, fossils, etc.

b) Decoration elements which limit individual decoration portions from each other, for example joints between ceramic tiles or joints between wood panels.

c) Decoration elements which form a separate image in addition to a material to be imitated, for example nail or screw heads in a wood panel, floral patterns on a plain decoration or lettering and logos.

d) Decoration elements which produce a pattern over a plurality of panels, for example the representation of edge friezes in the case of floor boards or streets of houses in the case of play floors.

One configuration of the invention is characterised in that the print position of the at least one decoration element on the surface to be provided with the decoration is predefined at random. The decoration element may in particular be the representation of a knot or of another typical wood feature in a wood decoration. In this way, wooden floor boards in particular can be imitated, with repetition of identical-looking wooden floor boards being ruled out owing to the random positioning of the decoration element or knot.

Alternatively or in addition, another configuration of the invention provides that the at least one decoration element is selected at random from a group of decoration elements. Thus, for example, a wood decoration, for example a pine decoration, can firstly be printed by means of roller printing (gravure printing) onto a carrier board made of wood material, By means of subsequent digital printing, two-dimensionally limited decoration elements, for example knots, are then printed onto the wood decoration of the carrier board, which decoration serves as a base. If the digital data of a plurality of visually different decoration elements or knots have been stored in a corresponding data store and then the variant selection is carried out by random generator, this results in a corresponding plurality of different floor boards. A combination of a random-generator-controlled selection of a decoration element from the plurality of variants and a likewise random-generator-controlled position selection in the x and/or y direction, that is to say in the longitudinal and/or transverse direction of each floor board, is particularly preferred and advantageous. In this way, each individual floor board can be designed in such a way that it is impossible or virtually impossible to find two identical floor boards among the floor boards produced in this manner. By extending a particular type of one decoration element, for example knot formations, by means of a further type of another decoration element, for example other "wood defects" and/or different stress marks such as dull spots, the number of variants can be increased still further.

The use of the present invention is not limited to wood decorations. The number of variants of wood material boards on which stone, tile or other imaginative decorations are printed can also be increased using the method according to the invention. Thus, for example, a natural stone decoration printed by means of roller printing (gravure printing) can be varied by printing "inclusions" or other distinctive spots onto the natural stone decoration which serves as a base by means of the at least one digital print head.

Another configuration of the method according to the invention is characterised in that one or more sub-areas of the surface which is to be provided with the decoration are printed on by means of the at least one printing roller unit, and in that one or more sub-areas which are not printed on by means of the at least one printing roller unit are printed on by means of the at least one digital print head. This configuration is advantageous in particular when the at least one decoration element which is printed by means of the at least one digital print head has a relatively large surface area and would cover a corresponding sub-area of a previously printed decoration. Since the sub-area which is printed on by means of the at least one digital print head after the roller printing is previously omitted during the roller printing, printing inks can be saved during the roller printing.

In terms of the device, this configuration is achieved in that the at least one printing roller unit comprises at least one printing roller, in particular engraved roller or rubber blanket roller, which has in its outer surface at least one recess for producing an unprinted region on the board-shaped main body or the carrier board.

This configuration also offers the possibility of varying the sequence of roller printing and digital printing, that is to say in this configuration the roller printing need not necessarily be carried out before the digital printing but can if necessary also be carried out after the digital printing. This configuration also makes it possible to arrange the at least one digital print head between two printing roller units which carry out the roller printing.

Another configuration of the invention consists in arranging a plurality of print heads in succession in the feed direction of the main body. This configuration makes it possible to achieve a high feed speed of the main body when printing thereon, the digital print heads, which usually operate more slowly than a printing roller unit, each printing part of the decoration element which is to be printed digitally. By dividing the tasks in this way, each digital print head taking on part of the digital printing work, the feed speed of the main body which is to be printed on can be increased.

Another configuration of the invention consists in the at least one digital print head being displaceable in the feed direction of the main body which is to be printed on. As a result, the digital print head can be given more time to print each decoration element, and therefore the high printing speed of the at least one printing roller unit can be maintained in spite of the usually comparatively lower printing speed of the digital print head.

BRIEF DESCRIPTION OF THE DRAWINGS

The invention will be described in more detail below with reference to drawings which show a plurality of embodiments and in which, schematically.

DETAILED DESCRIPTION OF THE INVENTION

Figure 1:
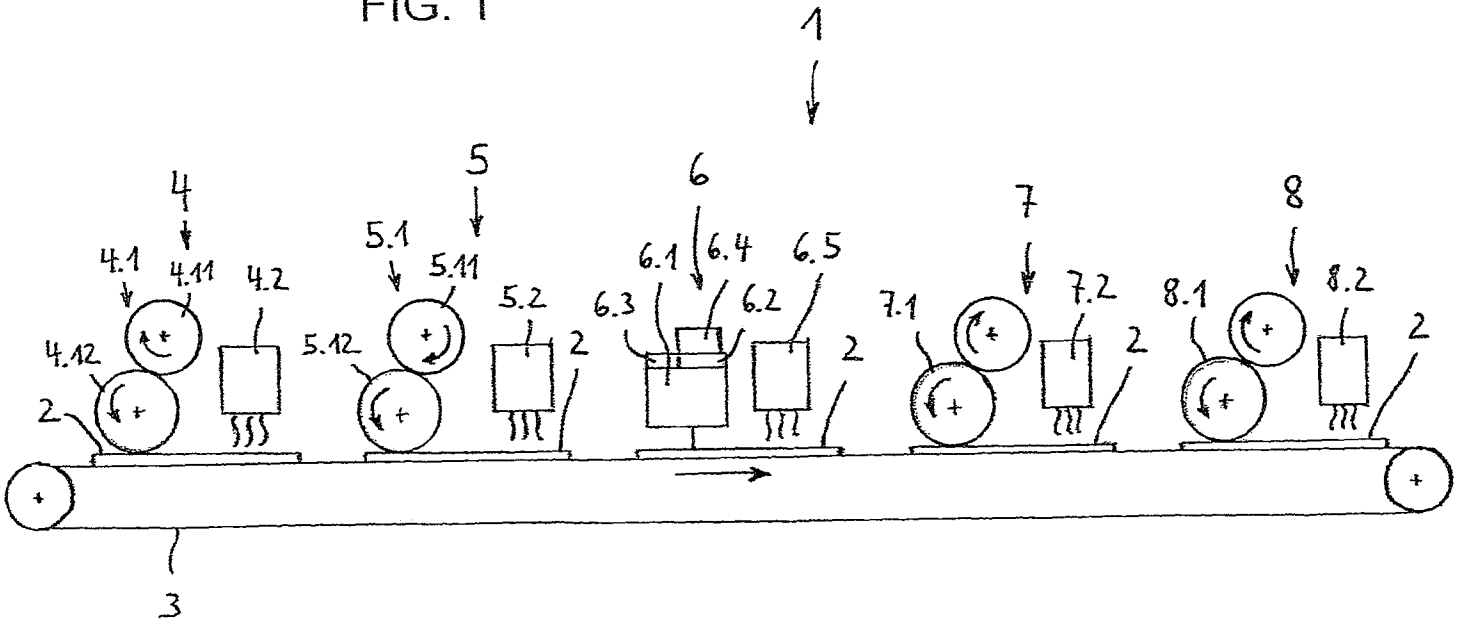
FIG. 1 is a side view of a device for producing board-shaped products having a surface comprising a decoration, which device comprises a plurality of printing stations.

FIG. 1 shows a device or system 1 for producing board-shaped products, for example floor, wall or ceiling panels, having a surface comprising a decoration.

A plurality of board-shaped main bodies 2 is arranged on a conveyor belt 3 and fed individually in turn to different processing stations 4, 5, 6, 7 and 8. The transport direction of the main bodies 2 is indicated by an arrow in FIG. 1 and extends from left to right. Instead of a plurality of individual main bodies 2, a large-scale workpiece or a continuously produced workpiece can also be processed, which workpiece is divided into individual boards (blanks) after the processing described below.

The workpiece and/or the main bodies 2 are produced from a carrier board made of wood material, of laminate and/or of at least one compact board. Compact boards are produced from resin-impregnated cellulose webs which are compressed under high pressure and at high temperatures in laminate presses.

However, the main bodies 2 are preferably ground wood material boards, for example particle boards, medium-density fibreboards (MDF boards), high-density fibreboards (HDF boards) or hardboards.

Downstream of a brush station (not shown) which removes any impurities or grinding dust, filler is applied in a plurality of stages by means of application rollers (not shown), intermediate drying taking place after each stage. A primer which is kept in the basic shade of a subsequently printed decoration is then applied by means of rollers (not shown) to the main body 2 thus provided, again in a plurality of stages, partial drying again taking place after each application.

The primed board-shaped main body 2 is then smoothed. This is preferably done by means of heated, polished steel rollers (not shown) which are operated over the width of the main body 2 at a peripheral speed which is greater or less than the feed speed of the main body 2, while being pressed against the main body 2. The board-shaped main body 2 which is treated in this way comprises over its entire upper face a surface which is even or uniform in colour, structure and degree of gloss.

Directly at the smoothing device (not shown), a decoration, preferably a wood decoration, is printed by means of two printing roller units 4.1, 5.1 which are each made up of an engraved printing roller (printing cylinder) 4.11, 5.11 together with inking and dampening rollers and a rubber blanket cylinder 4.12, 5.12 together with an impression cylinder (not shown). This printing method is also referred to as indirect gravure printing.

Finishing devices 4.2, 5.2 are arranged downstream of the printing roller units 4.1, 5.1. The finishing devices 4.2, 5.2 can dry or partially dry the printed ink for example by means of a hot air current or by means of electromagnetic radiation, in particular UV radiation.

Instead of two or more printing roller units 4.1, 5.1, the device or system 1 according to the invention may optionally also comprise only a single printing roller unit 4.1 or 5.1.

According to the invention, at least one decoration element is printed onto one or more sub-regions of the board-shaped main body 2 by means of at least one digital print head 6.1 such that the previously printed decoration remains visible, at least in part, or the previously printed decoration surrounds the decoration element.

The digital print head 6.1 operates for example according to the principle of the jet pressure method, which is widely used in so-called ink jet printers. In FIG. 1, a short dash is drawn under the digital application device 6.1 and indicates a droplet jet or a plurality of droplet jets positioned in line. The digital application device 6.1 is designed in such a way that it prints one or more decoration elements onto the main body in places or line by line, transverse to the direction of movement of the main body 2. This digital print thus does not print all over, but only in part.

The digital print head 6.1 can print in one colour or a plurality of colours. For example, the digital print head 6.1 can be fitted with an ink cartridge which contains a single colour or coloured ink. Alternatively or in addition, however, the digital print head 6.1 can also be provided with one or more ink cartridges which comprise or form a plurality of chambers having different inks or colours, for example contain the colours yellow, blue and red as primary colours, such that the digital print head 6.1 can also print a plurality of or different colours simultaneously in one pass.

The decoration elements are for example representations of knots (i.e. knot cross-sections), inclusions, intergrowths, grain defects, burls, annual rings, representations of light sap wood, worm grooves (e.g. woodworm holes/grooves), nail and/or screw heads, etc. In addition or alternatively, the decoration elements may also be inclusions or other distinctive spots of stone or imaginative decorations.

In the present context, the term "decoration element" can also be understood to mean logos. The logos are for example company names, word/figurative marks, slogans, overprints as conventionally found on freight boxes, etc.

A computer 6.2 is also connected to the digital application device 6.1 as a means for producing a dot distribution for controlling said application device. The computer 6.2 prepares digital control information and transfers this to the digital print head 6.1.

The image data of different variants of said decoration elements and/or logos are stored in a data store 6.3 of the computer 6.2. The computer 6.2 is also provided with a random generator 6.4. The random generator 6.4 is used to select at random different variants of one or more decoration elements, for example knots and light sap wood portions, and to predefine, also at random, the position of each decoration element on the carrier board 2 in the x and/or y direction.

It also falls within the scope of the invention that the computer can not only select a decoration element at random from a plurality of decoration elements, but also modify a decoration element, in particular make it look different. Thus, for example, the shape of an elliptical decoration element can be modified by varying the length of the major and/or minor axis of the ellipse. The invention also includes a configuration in which the computer can even produce decoration elements at random, for example geometric shapes such as a circle, a square, triangles, trapeziums, polygons, or lines or even complex decoration elements.

A finishing device 6.5 is also located downstream of the digital application device 6.1, as before in the case of the roller printing units 4.1, 5.1, in order to dry the previously applied decoration element(s).

The digital application device 6.1 and the finishing device 6.5 are followed by processing stations 7, 8, by means of which a sealing layer (wear protection layer) is applied to the decoration including the printed decoration elements.

A transparent varnish coating which can be cured by UV radiation is applied in at least two stages as a seal for the decoration. The sealing varnish contains corundum particles and/or other particles which increase resistance to abrasion. If the decorative main bodies or boards 2 are of a type which is not exposed to heavy abrasion, for example furniture parts, in particular rear walls for cupboards, then the sealing varnish can also be free from corundum particles or other particles which increase resistance to abrasion.

A substantially all-over coat of a transparent, UV-curable sealing varnish is applied in the processing station 7. For this purpose, the processing station 7 comprises an application roller 7.1 which applies a uniform layer of varnish to the upper face of the main body 2. In the downstream finishing device 7.2 the applied coat is dried and cured, at least in part.

In the processing station 8 a coat of a transparent, UV-curable sealing varnish is applied directly, again by means of an application roller 8.1, in this case the amount applied varying in relation to the board surface. This results in a possibly intentional three-dimensional structuring of the upper varnish layer.

The coat applied last is then cured at least in part by means of the finishing device which follows the application roller 8.1, so as to fix the three-dimensional structuring before it flows off.

The entire upper face of the board-shaped main body 2 can initially be provided with a decoration, for example a wood or stone decoration, by the roller printing units 4.1, 5.1, one or more individual surface regions of each main body 2 then also being printed on by the at least one digital printer 6.1.

Alternatively or in addition, the invention provides that only a particular surface region of each main body 2 is printed on by the roller printing method and that the unprinted region(s) is/are printed on by means of at least one digital printer 6.1. This configuration is sketched in FIG. 2, which shows that a printing roller unit comprises at least one printing roller, in particular rubber blanket roller 5.12, which has in its outer surface at least one recess 5.13 for producing an unprinted region 2.1 on the board-shaped main body 2. A digital printer 6.1 is arranged downstream of the printing roller 5.12 and is connected to a control system 6.2 which comprises a random generator 6.4, the control system selecting a decoration element to be printed in the board region 2.1 at random from a group of decoration elements, or producing said decoration element.

Figure 2:
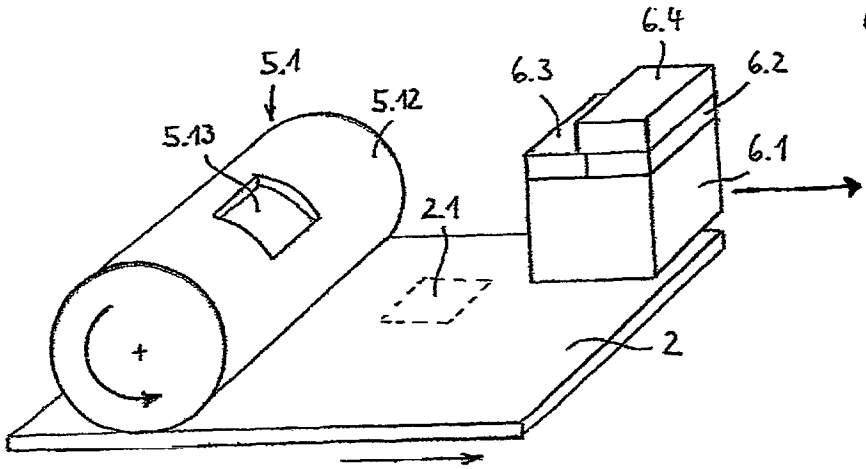
FIG. 2 is a perspective view of a printing roller of a printing roller unit for a device according to FIG. 1.

Using a printing roller unit 5.1 of the type sketched in FIG. 2, in combination with a digital printer 6.1, it is possible to create for example imaginative decorations comprising a stone or tile pattern, in which a basic decoration produced by the printing roller 5.12 is supplemented or completed by decorative tiles, ornaments, inlaid images, logos, etc. which are printed in the initially unprinted regions 2.1 by digital printing.

In the case of regular decorations, for example an image of a pebble stone surface, pile of coffee beans, etc., the decoration can be varied using a device according to FIG. 2, in that the otherwise regular ornament arrangement on the printing roller (engraved roller or rubber blanket cylinder 5.12) is deliberately provided with recesses (or engraving-free zones) 5.13, modified ornaments being printed by the digital printer 6.1 in the regions 2.1 of the board-shaped main body 2 which are produced by these engraving-free zones, for example in a different colour or in another orientation or distorted, etc.

Figure 3:
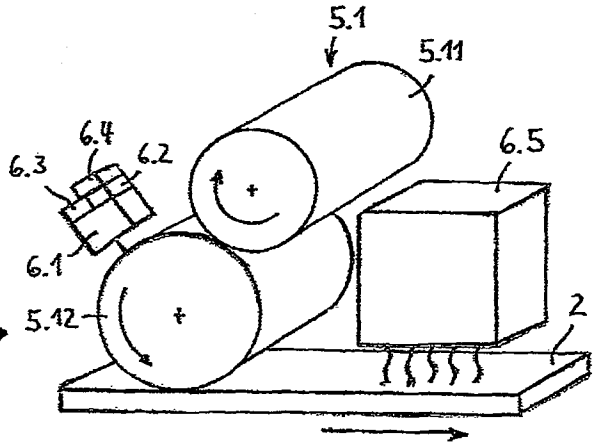
FIG. 3 is a perspective view of a printing roller unit having an associated digital print head.

FIG. 3 shows an embodiment of a device according to the invention, at least one digital print head 6.1 being associated with a rubber blanket roller 5.12 of a printing roller unit 5.1. The digital printer 6.1 prints onto the rubber blanket roller 5.12, which transfers the decoration element applied by means of the digital print head 6.1 onto the main body 2 which is to be printed on. The decoration applied in this manner is dried at least in part by means of the downstream finishing device 6.5.

Using a device 1 according to FIG. 1, it is in particular possible to print a decoration as a multicoloured decoration, a different colour of the decoration being printed onto the main body 2 by each of the printing roller units 4.1, 5.1, and one colour of the multicoloured decoration being printed onto the main body 2 by means of the digital printing station 6 comprising the at least one digital print head 6.1. Thus, for example, different wood decorations (wood types) can be printed without changing the printing rollers, at least so long as the wood types do not differ too greatly in terms of their typical basic structure (grain). This saves considerable set-up time, it being possible to carry out the required ink change alone comparatively easily and quickly.

Figure 4:
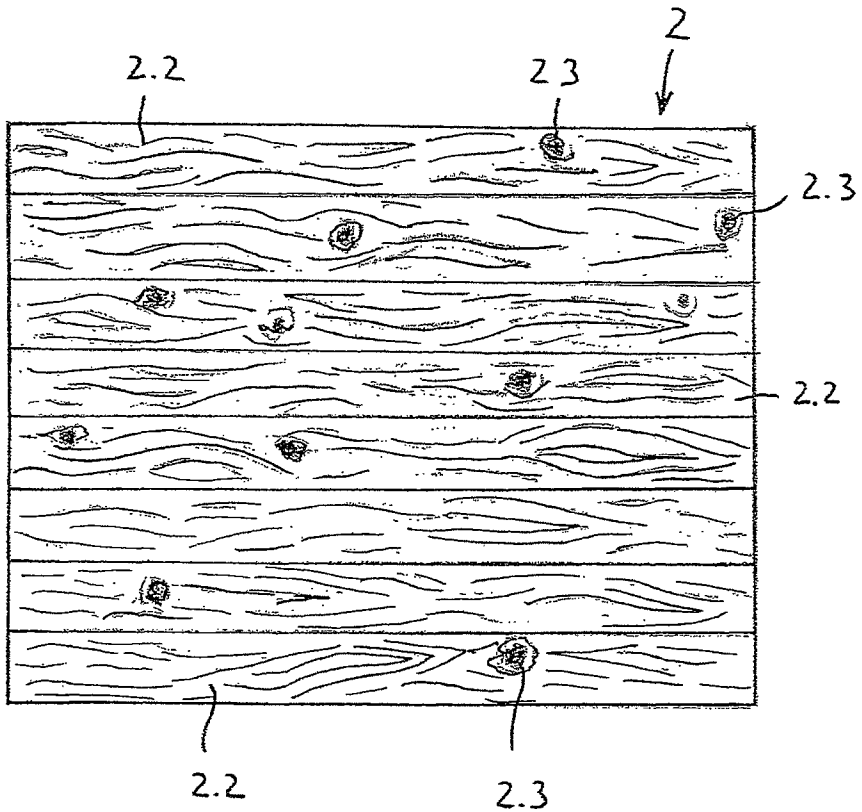
FIG. 4 is a plan view of a board-shaped product having a surface comprising a decoration.

FIG. 4 is a plan view of a board 2 produced by the method according to the invention, which board has a surface comprising a decoration. The board 2 comprises a wooden floor board decoration 2.2 produced by means of printing rollers 4.1, 5.1. The surface of the board 2 also comprises decoration elements 2.3 in the form of knots, produced by means of at least one digital print head 6.1. The shape and/or size of the knots 2.3 and the position thereof on the surface have been set at random. For this purpose, the at least one digital print head 6.1 is connected to a control system 6.2 which comprises a random generator 6.4 (cf. FIG. 1), selects each knot image 2.3 as a decoration element at random from a group of decoration elements and also predefines at random the print position of each knot image 2.3 on the surface of the board 2, which surface is to be provided with the decoration 2.2.

Figure 5:
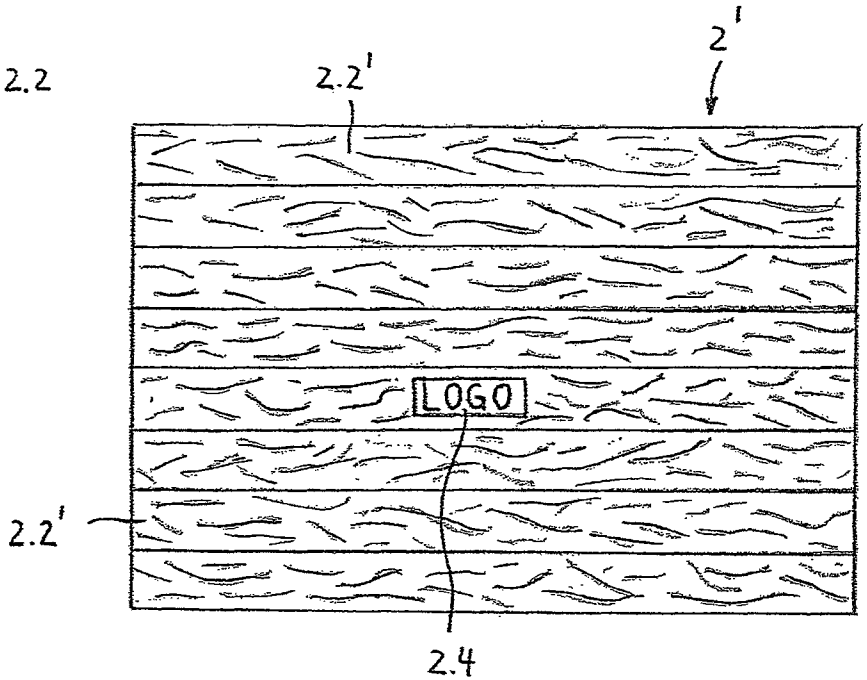
FIG. 5 is a plan view of a further board-shaped product having a surface comprising a decoration.

FIG. 5 shows schematically a board 2' produced by the method according to the invention, which board likewise comprises a wooden floor board decoration 2.2' produced by means of printing rollers 4.1, 5.1. The surface of the board 2' also comprises a logo 2.4 produced by means of a digital print head 6.1. A device according to FIG. 2 is particularly suitable for producing a board 2' having a decoration 2.2', 2.4 of this type, but devices according to FIGS. 1 and 3 are also suitable.

The implementation of the invention is not limited to the above-described embodiments. Rather, numerous variants and combinations are conceivable which also use the invention given in the appended claims even in the case of basically different styling.

The invention claimed is:

1. A method for producing a board-shaped product having a surface comprising a wood or stone decoration, the method comprising:

printing a wood or stone decoration by at least one printing roller unit for gravure printing onto a main body which is formed from a carrier board made of wood material, of laminate, of a compact board, or of all three said materials; and printing at least one decoration element by at least one digital print head for one or more sub-regions of the main body such that the wood or stone decoration which is printed by the at least one printing roller unit remains visible, at least in part, or surrounds the at least one decoration element, wherein, if the wood or stone decoration comprises a wood decoration, the at least one decoration element depicts a texture of the wood to be imitated, the texture comprising at least one of a knot, resin, a gall, a worm groove, and a stain, or depicts a nail, a screw head, or a joint between wood panels, and wherein, if the wood or stone decoration comprises a stone decoration, the at least one decoration element depicts a texture of the stone to be imitated, the texture comprising at least one of a stain, an inclusion, and a fossil, or depicts a joint between stone tiles, wherein the at least one digital print head is displaced together with the main body in the feed direction thereof.

2. The method according to claim 1, wherein the entire area of the surface which is to be provided with the wood or stone decoration is printed on by the at least one printing roller unit, and wherein the at least one decoration element is printed on the wood or stone decoration by the at least one digital print head.

3. The method according to claim 1, wherein the print position of the at least one decoration element on the surface to be provided with the wood or stone decoration is predefined at random.

4. The method according to claim 1, wherein during production of elongate panels from the main body, the print position of the at least one decoration element on the surface to be provided with the wood or stone decoration is predefined at random in the longitudinal transverse direction of each panel.

5. The method according to claim 1, wherein one or more sub-areas of the surface which is to be provided with the wood or stone decoration are printed on by the at least one printing roller unit, and wherein one or more sub-areas which are not printed on by the at least one printing roller unit are printed on by the at least one digital print head.

6. The method according to claim 1, wherein the at least one decoration element is selected at random from a group of decoration elements.

7. The method according to claim 1, wherein the at least one decoration element is produced at random by a computer.

8. The method according to claim 1, wherein the at least one digital print head prints the at least one decoration element on a printing roller of the at least one printing roller unit such that said printing roller prints the at least one decoration element onto the surface to be provided with the wood or stone decoration.

9. The method according to claim 1, wherein the wood or stone decoration is printed as a multicoloured wood or stone decoration by a plurality of printing roller units, a different colour of the wood or stone decoration being printed onto the carrier board by each of the printing roller units, and one colour of the multicoloured wood or stone decoration being printed onto the main body by a digital printing station or by a digital printing station comprising the at least one digital print head.

10. The method according to claim 1, wherein a plurality of digital print heads are arranged in succession in the feed direction of the main body.

11. A device for producing a board-shaped product having a surface comprising a wood or stone decoration, the device comprising:

at least one printing roller unit for gravure printing a wood or stone decoration onto a main body which is formed from a carrier board made of wood material, of laminate, of a compact board, or of all three said materials; and at least one digital print head for printing at least one decoration element onto one or more sub-regions of the main body such that the wood or stone decoration which is printed by the at least one printing roller unit remains visible, at least in part, or surrounds the at least one decoration element, wherein, if the wood or stone decoration comprises a wood decoration, the at least one decoration element depicts a texture of the wood to be imitated, the texture comprising at least one of a knot, resin, a gall, a worm groove, and a stain, or depicts a nail, a screw head, or a joint between wood panels, and wherein, if the wood or stone decoration comprises a stone decoration, the at least one decoration element depicts a texture of the stone to be imitated, the texture comprising at least one of a stain, an inclusion, and a fossil, or depicts a joint between stone tiles, wherein the at least one digital print head is configured to be displaced together with the main body in the feed direction thereof.

12. The device according to claim 11, wherein the at least one digital print head is connected to a control system which comprises a random generator and predefines at random the print position of the at least one decoration element on the surface which is to be provided with the wood or stone decoration.

13. The device according to claim 11, wherein the at least one digital print head is connected to a control system which comprises a random generator and selects the at least one decoration element at random from a group of decoration elements.

14. The device according to claim 11, wherein the at least one digital print head is connected to a control system which comprises a random generator and produces the at least one decoration element at random.

15. The device according to claim 11, wherein the at least one printing roller unit comprises at least one printing roller, the at least one printing roller comprising an engraved roller or rubber blanket roller, which has in an outer surface at least one recess for producing an unprinted region on the board-shaped main body.

16. The device according to claim 11, further comprising a plurality of printing roller, units and at least one digital printing station, which comprises the at least one digital print head, for printing the wood or stone decoration as a multicoloured wood or stone decoration, wherein each of the printing roller units and the digital printing station is used to print a different colour of the wood or stone decoration.

17. The device according to claim 11, wherein a plurality of digital print heads are arranged in succession in the feed direction of the main body.

18. The method according to claim 1, wherein the at least one digital print head prints the at least one decoration element onto the surface to be provided with the wood or stone decoration.

* * * * *